United States Patent [19]

Page

[11] Patent Number: 4,861,035

[45] Date of Patent: Aug. 29, 1989

[54] GOLF PRACTICE APPARATUS

[76] Inventor: Joseph U. Page, 58 Douglas Avenue, Ottawa, Ontario K1M 1G2, Canada

[21] Appl. No.: 152,303

[22] Filed: Feb. 4, 1988

[51] Int. Cl.[4] ..... A63B 67/10; A63B 69/36

[52] U.S. Cl. ..... 273/184 B; 273/185 C; 273/333

[58] Field of Search ..... 273/35 R, 184 R, 184 B, 273/185 C, 199 R, 196, 197 R, 197 A, 198, 183 C, 200 R, 331–335, 340, 348, 371, 374, 386–389, 381, 382, 378, 26 E, 58 C, 29 A, 185 D, 375, 26 EA, 200 A

[56] References Cited

U.S. PATENT DOCUMENTS 903,679 11/1908 Courtney ..... 273/333
3,143,351 8/1964 Bertrand ..... 273/184 B
3,194,557 7/1965 Holley ..... 273/26 E
3,312,470 4/1967 Ames ..... 273/413

*Primary Examiner*—Edward M. Coven
*Assistant Examiner*—S. Passaniti
*Attorney, Agent, or Firm*—R. William Wray & Associates

[57] ABSTRACT

Golf practice apparatus is described in which a tethered ball is suspended below a support portion. This may be a right-angled stake or a vertical wood portion on a flat wooden base portion. Two electrical contact members are mounted above the golf ball so that when the golf ball is struck by a player, if the ball is hit squarely it will strike one of the contact members so that it makes contact with the other member. An electrical circuit is thus completed to activate a buzzer or a visual indication. If the ball is not hit squarely, then no indication is given.

12 Claims, 1 Drawing Sheet

GOLF PRACTICE APPARATUS

BACKGROUND OF THE INVENTION

This invention relates to a golf practice apparatus of the type in which a tethered ball is struck by a golfer.

Golfers often spend many hours practicing their golf swing in order to achieve a swing where the ball is struck squarely and moves in the direction required by the golfer. Apparatus has previously been proposed to assist the golfer in achieving a perfect swing and one such apparatus is disclosed in U.S. Pat. No. 3,169,771, issued Feb. 16, 1965. That patent discloses a golf practice device of the type in which a tethered ball is struck towards a target. In that device the ball returns automatically and is provided with marking material for indicating on the club whether or not the ball has been fairly struck.

It is an object of the present invention to provide golf practice apparatus in which a ball in starting position may be struck by any golf club and an indication is given as to whether or not the ball has been fairly struck, independently of any marking on the club.

SUMMARY OF THE INVENTION

According to the present invention there is provided golf practice apparatus comprising a support portion, a tethered ball freely suspended below a point on said support portion, a first and a second member spaced above said point whereby when said ball strikes the first member said first and second members make contact, and indicating means to provide an indication when said first and second members make contact.

According to another aspect of the invention there is provided golf practice apparatus comprising a horizontal base portion, a vertical support portion having a horizontally-extending portion spaced from and above said base portion, a tethered ball freely suspended below a point on said horizontally-extending portion, a first and a second member spaced above said point whereby when said ball strikes the first member said first and second members make contact, and indicating means to provide an indication when said first and second members make contact.

IN THE DRAWINGS

Some embodiments of the invention will now be described, by way of example, with reference to the accompanying drawings in which:

FIG. 1 is a perspective view of golf practice apparatus according to one embodiment of the invention, FIG. 2 is a sectional view taken on the line II—II of FIG. 1, FIG. 3 is a diagram of a typical electrical circuit forming part of the apparatus of FIG. 1, and FIG. 4 is a diagrammatic representation of a second embodiment of the invention.

DESCRIPTION OF PREFERRED EMBODIMENTS

Figure 1:
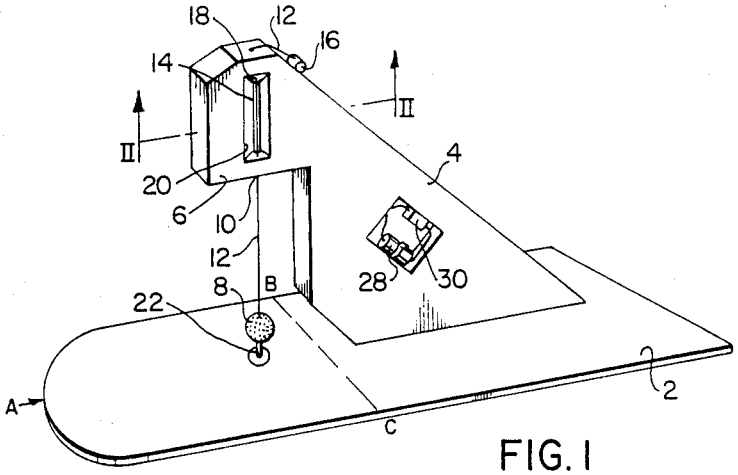
Figure 2:
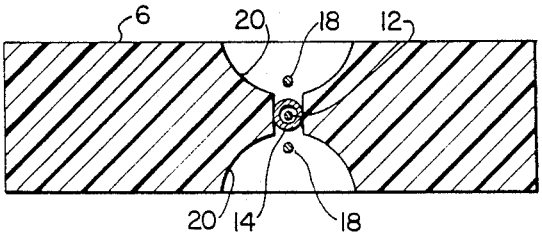

Referring to FIGS. 1 and 2, the embodiment illustrated includes a base portion 2 and a vertical support portion 4, both constructed of wood or other suitable material. The vertical support portion 4 is integrally attached to the base portion 2 as shown in FIG. 1 and includes a horizontally extending portion 6. A ball 8 is tethered below a point 10 on said horizontally extending portion 6. It will be understood that the ball 8 may be a golf ball, a practice golf ball, or any ball simulating a golf ball or any object suitable for the illustrated golf practice apparatus.

The tethered ball 8 is freely suspended below the point 10 by means of an attached flexible steel cable 12. The steel cable 12 passes through an aperture in the portion 6, through a copper rod 14 and then through a further aperture in the upper part of portion 6 and its upper end is fastened to a fastening ring member 16. The distance from point 10 to the outside corner of portion 6 is approximately three inches.

As will be seen from FIGS. 1 and 2, the rod 14 is located in the center of the horizontally-extending portion 6 and between the two flat larger surfaces thereof. The copper tube is a quarter-inch in diameter and on either side of the copper tube a wire 18 is located one-sixteenth of an inch from the tube or rod 14. The wires 18 are No. 18 SWG. As will be appreciated, in some cases only one wire 18 needs to be provided.

In the vicinity of the copper rod 14, the horizontally-extending portion 6 is cut out and shaped so as to provide an area 20 which is curved to correspond to half the circumference of ball 8 and towards the quarter-inch gap required for copper rod 14. The area 20 has a width of one and five-eighths inches which is equal to the diameter of the ball 8.

The distance of the ball 8 from the point 10 is adjustable depending on the type of club used but in the illustrated embodiment, the ball 8 rests on the tee member 22.

Figure 3:
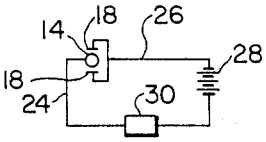

In FIG. 3 the electrical circuit of the apparatus of FIG. 1 is illustrated. A wire 24 is connected to the copper rod 14 whilst a wire 26 is electrically connected to each of the wires 18. The circuit includes a battery 28 and a buzzer device 30. The latter, if desired, may include a relay or other device for extending the time of operation of the buzzer to ensure that it is heard.

Although a buzzer device 30 has been indicated in FIG. 3, it will be understood that the indicating means may alternatively comprise a visual indicator means may alternatively comprise a visual indicator or both an audible and a visual indication may be given. In fact, the indication means may be of any suitable type.

In use, the base portion is placed on a level service either inside or outside a building. The ball is then addressed, the player standing beyond the rounded end of base portion 2 facing towards the ball 8 in FIG. 1.

The ball is then struck with any chosen club whereby the tethered ball 8, if hit correctly, will travel at right angles, initially, to the vertical support portion 4 and pivot about the point 10 so as to strike one of the wires 18. The respective wire 18 will then be forced to move so as to contact the copper rod 14. This completes the electrical circuit of FIG. 3 and will cause the buzzer 30 to be energized whereby an audible indication will be given to the player that he has hit his shot fairly and correctly.

If the player does not hit the ball 8 correctly, then the ball 8 will not make contact with the respective wire 18 but will strike a part of the vertical support portion 4 and no indication will be given. Since the width of portion 20 is equal to the diameter of ball 8, the ball must be hit precisely and dead center to cause an indication to be given. Otherwise, the ball makes contact with the sloping sides of portion 20 or the plane surface of portion 6.

It will be understood that the dimensions of the apparatus are such that when the club head passes through the shot after contact with ball 8, the club swing continues without impedance by the vertical support portion 6. After the ball 8 has been struck and, normally, impinges on the apparatus, it bounces away and returns to its normal position automatically so that the player does not have to lean over to position the ball on the tee 22.

Figure 4:
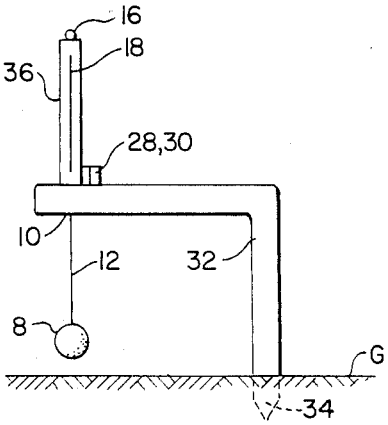

In FIG. 4, a second embodiment of apparatus according to the invention is diagrammatically illustrated. Where possible the same reference numerals have been used for like parts in FIG. 4 as were used in FIG. 1.

In FIG. 4, the golf practice apparatus includes a right-angled stake 32 which is pointed at one end 34 so that it can be driven into the ground G. Adjacent the other end of the stake, it is drilled so that the flexible steel cable 20 can pass therethrough and through a structure 36 which contains the copper rod 14 (not visible) and the wires 18.

It will be understood that instead of a flexible steel cable 12, any suitable supporting means may be used, for example a string could be substituted for the steel cable. Conveniently a three-second indication could be provided by the buzzer 30.

It will also be understood that the apparatus can be molded from plastic instead of being constructed of wood. The dimensions of the apparatus may, of course, vary, but experiments have indicated that the dimensions given above are particularly appropriate for the illustrated golf practice apparatus.

It will be understood that a wire 18 more rigid than 18 SWG may be used to give greater reliability and reduce spurious operation of the buzzer device 30 or other indication.

It will also be understood that the portion A to the line BC in FIG. 1 may be omitted. This will permit better use of the apparatus in some situations using woods or irons. The tee member 22 is not, of course, always required.

As will be apparent to those familiar with the art, the invention may be embodied in other specific forms without departing from the spirit or essential characteristics thereof. The embodiments disclosed are therefore to be considered in all respects as illustrative rather than restrictive, the scope of the invention being indicated by the appended claims.

I claim:

1. Golf practice apparatus comprising:

(a) a support portion, (b) a tethered ball freely suspended below a point on said support portion, (c) an electrical circuit including indicating means in a normally-inoperative condition, (d) a member spaced above said point whereby when said ball strikes said member said electrical circuit is completed whereby said indicating means is energized from said normally-inoperative condition to an operative condition to provide an indication.

2. Apparatus according to claim 1 wherein said ball is suspended by a flexible steel cable.

3. Apparatus according to claim 1 wherein said ball is suspended by a string.

4. Golf practice apparatus comprising:

(a) a support portion, (b) a tethered ball freely suspended below a point on said support portion, (c) a first and a second member spaced above said point whereby when said ball strikes the first member said first and second member make contact, and (d) indicating means to provide an indication when said first and second members make contact, (e) wherein said second member is a metallic rod, and said first member is a wire parallel to and spaced from said rod on one side.

5. Apparatus according to claim 4 wherein said first member includes a further wire parallel to and spaced from said rod and diametrically opposite to said first-mentioned wire.

6. Apparatus according to claim 4 or 5 wherein each wire is connected to one connecting wire in an electrical circuit and said rod is connected to a second connecting wire in said electrical circuit, the electrical circuit including said indicating means to provide an audible and/or visible indication when said first and second members make contact.

7. Apparatus according to claim 5 wherein the distance of said tethered ball from said point is adjustable.

8. Apparatus according to claim 1 wherein said support portion is a right-angled stake having one end pointed for insertion in the ground.

9. Golf practice apparatus comprising:

(a) a horizontal base portion, (b) a vertical support portion having a horizontally-extending portion spaced from and above said base portion, (c) a tethered ball freely suspended below a point on said horizontally-extending portion, (d) an electrical circuit including indicating means in a normally-inoperative condition, (e) a member spaced above said point whereby when said ball strikes said member said electrical circuit is completed whereby said indicating means is energized from said normally-inoperative condition to an operative condition to provide an indication.

10. Apparatus according to claim 9 wherein a tee member is provided on said base portion.

11. Apparatus according to claim 1 wherein said indication is an audible indication.

12. Apparatus according to claim 1 wherein said indication is a visible indication.

* * * * *